US006243995B1

(12) United States Patent
Reeves et al.

(10) Patent No.: US 6,243,995 B1
(45) Date of Patent: Jun. 12, 2001

(54) METHOD AND APPARATUS FOR CLOSING OPENINGS UNDER TILES ALONG EAVE LINE

(75) Inventors: Eric Norman Reeves, San Jose; Jason Reeves, Santa Clara, both of CA (US)

(73) Assignee: So-Lite Corporation, San Jose, CA (US)

( * ) Notice: Subject to any disclaimer, the term of this patent is extended or adjusted under 35 U.S.C. 154(b) by 0 days.

(21) Appl. No.: 09/374,092

(22) Filed: Aug. 12, 1999

(51) Int. Cl.[7] ..... E04B 7/00
(52) U.S. Cl. ..... 52/94; 52/96; 52/302.3
(58) Field of Search ..... 52/94, 95, 96, 52/302.3

(56) References Cited

U.S. PATENT DOCUMENTS

| | | | | |
|---|---|---|---|---|
| 2,624,298 | * | 1/1953 | Farren | 52/302.3 X |
| 3,488,902 | * | 1/1970 | Gobel | 52/94 |
| 4,017,090 | * | 4/1977 | Cohen | 52/94 X |
| 4,371,293 | * | 2/1983 | Wilcox et al. | 405/259 |
| 4,798,033 | * | 1/1989 | Weidl | 52/94 |
| 4,848,045 | * | 7/1989 | Nichols et al. | 52/96 X |
| 4,848,049 | * | 7/1989 | Hanson | 52/97 |
| 4,970,832 | * | 11/1990 | Van Herpen | 52/60 X |
| 4,989,689 | * | 2/1991 | Berlin | 182/45 |
| 5,178,292 | * | 1/1993 | Korzeniowski | 220/1.5 |
| 5,274,974 | * | 1/1994 | Haag | 52/300 |
| 5,377,463 | * | 1/1995 | Howe | 52/200 |
| 5,414,965 | * | 5/1995 | Kelley et al. | 52/60 |
| 5,493,819 | * | 2/1996 | Acosta-Torres | 52/94 |
| 5,619,827 | * | 4/1997 | Church | 52/60 |
| 5,636,481 | * | 6/1997 | De Zen | 52/95 |
| 5,768,842 | * | 6/1998 | Austin | 52/302.3 |
| 5,832,677 | * | 11/1998 | Kurttilla | 52/95 |
| 5,882,043 | * | 3/1999 | Murphy et al. | 285/42 |
| 5,921,038 | * | 7/1999 | Burroughs et al. | 52/95 X |

* cited by examiner

*Primary Examiner*—Bruce A. Lev
(74) *Attorney, Agent, or Firm*—Donald R Boys; Central Coast Patent Agency

(57) ABSTRACT

An eave closure for tile roofing has a nailing flange with a surface extending along a full length of the closure, and a riser portion contiguous with the nailing flange at substantially a right angle to the surface of the nailing flange, the riser portion shaped on an upper edge to conform to the shape of the underside of adjacent installed tiles. The riser portion has molded reinforcing grooves adding vertical strength to the eave closure to provide adequate strength to combat permanent deformation in use. In some cases weep passages are also provided, and the weep passages may have at least one change in direction to foil wind-driven rain. In some embodiments a second enclosure is provided to be installed with the first, to hide the reinforcing grooves. In another embodiment an injection-molded closure is provided with angled reinforcements.

10 Claims, 7 Drawing Sheets

METHOD AND APPARATUS FOR CLOSING OPENINGS UNDER TILES ALONG EAVE LINE

FIELD OF THE INVENTION

The present invention is in the field of roofing construction and pertains particularly to methods and apparatus for closing the ends of an installed row of roofing tiles along the eave area.

BACKGROUND OF THE INVENTION

In the field of roofing construction, one of the most popular and sought-after coverings is tile. A tile roof is a roofing system comprising a plurality of individual tiles made of fired clay, or more recently a composite material, constructed, shaped, and arranged on a roof to lie side by side in overlapping fashion so as to completely cover a roof. A Spanish or Mission-style tiled roof is arguably the most recognized and admired by consumers.

One of the most evasive problems facing a tiled roof, because of the means of overlapping tiles, is wind-driven rain. Wind-driven rain may travel nearly horizontally, and in more severe instances, diagonally upward and against a tiled roof causing moisture to be forced up underneath tiles, and water may thus enter a structure through gaps and openings presented by the roofing tiles, causing water damage. There has been much experimental work done to develop methods and materials in an effort to reduce the threat of wind-driven rain.

An area on a tiled roof that is sometimes vulnerable to such damage is the end-row of tiles installed along the eaves at the edge of a roof. This is the area on a roof where a first row of tiles is installed. Typically, interlocking tiles are nailed to a cross-member, termed a bat in the art, that runs horizontally back from the edge of the roof. Because the tiles are nailed to the bat instead of directly to the underlayment (typically plywood), the undersurface of the row of tiles at the edge is suspended approximately one-half of an inch or so above the surface of the underlayment. This fact presents an opening and other problems, and the curvature of the tiles presents further openings to the outside environment.

There are obvious problems with this type of installation that require extra means for correction. For example, the shape or profile of the tiles along with the above-surface position of the entire tile row provides for an open space underneath the tiles. More obviously, the hollow area under each tile is large enough for birds, insects, and other small animals to enter and perhaps nest in. The space under the interlocking portion between two adjacent tiles is large enough for insects to invade. Moreover, if these areas are left open, wind-driven rain may enter.

One of the more common prior art systems designed to combat the above problems uses an L-shaped closure made of sheet metal. Such a closure is manufactured in approximately 10-foot lengths. One leg of the L-shape is a nailing flange for nailing into the underlayment. The shape of the risers is intended to conform with the serpentine profile of the row of tiles leaving approximately one-half inch of riser to cover the gap at the interlocking portion in-between adjacent tiles. This design prevents nesting animals and most insects from entering through the covered areas, as long as the closure remains undamaged. Sealant materials may be applied to the edges of the riser and underside of the tiles in a further attempt to close gap areas in order to further reduce the chance of water invasion and insect invasion.

One problem with the prior art method and closure described above is that the sheet metal is malleable and not reinforced. If someone walks on the edge of a tiled roof, putting weight on the tiles, such as to make a repair, or to replace a broken tile, the sheet metal will crumple under the force of the weight, because the unsupported tiles give under the weight. After the weight is removed from the area, the tiles will spring back into position but the sheet-metal riser will not. This results in gaps between the crumpled area of the metal and the underside of the tile allowing insects and rain to again enter.

Other problems also exist. For example, after applying a sheet-metal closure, there will be small gaps remaining wherever the riser portion of the closure does not fully conform with the serpentine profile of the tile row. This problem is partially due to the linear dimensional error which rises additively from tile to tile over a long horizontal distance such as the edge of a roof. Often pieces of the riser must be cut and trimmed to get a good linear match of profiles. Furthermore, if the small remaining gaps are sealed, the roof cannot breathe properly which may cause moisture to form underneath contributing to wood rot.

What is clearly needed is a method and apparatus for closing the open areas along an eave row of tiles, such that the closure is resilient so it springs back if deformed. Such a closure apparatus would protect the roof underlayment from animals, insects, and rain by providing an optionally sealed closure having suitable venting means to allow the roof to breathe and moisture to weep out. Such a method and apparatus could be manufactured inexpensively in lengths that are more amenable to installation.

SUMMARY OF THE INVENTION

In a preferred embodiment of the present invention an eave closure for tile roofing is provided, comprising a nailing flange having a surface extending along a full length of the closure; and a riser portion contiguous with the nailing flange at substantially a right angle to the surface of the nailing flange, the riser portion shaped on an upper edge to conform to the shape of the underside of adjacent installed tiles. The riser portion has molded reinforcing grooves adding vertical strength to the eave closure.

In some embodiments eave closure is further characterized in that the nailing flange has weep passages formed along a width of the flange, such that air may circulate between inside and outside an installed closure. These weep passages may each follow a center line, and there may be at least one change in direction of the center line across the width of the nailing flange. The material is preferably a weather-resistance polymer material. Still further, in some preferred embodiments the length of a single closure is equal or less than four feet, providing for compensating for errors in center-to-center distances between adjacent installed tiles.

In another aspect of the invention methods for practicing the invention using the apparatus taught are also provided.

In yet another embodiment an eave closure for tile roofing is provided, comprising a first flange having a surface extending along a length of the closure; a first riser portion contiguous with the nailing flange at an angle to the surface of the nailing flange, the riser portion shaped on an upper edge to conform to the shape of the underside of adjacent installed tiles, the first riser portion having molded reinforcing grooves adding vertical strength to the eave closure; a second riser portion congruent with and adjacent to the first riser portion, the second riser portion having a smooth surface devoid of reinforcing grooves; and a second flange extending from the second riser portion in a direction opposite the direction of the first flange.

In still another embodiment an eave closure for tile roofing is provided, comprising a flange having a surface extending along a length of the closure; a riser portion contiguous with the nailing flange at an angle to the surface of the nailing flange, the riser portion shaped on an upper edge to conform to the shape of the underside of adjacent installed tiles; and angled reinforcements joining the flange and riser portions.

In the embodiments taught, for the first time an eave closure is provided in the art that will support the weight of workmen on the roof, and solve the problem of bent and damaged closures, while still allowing adequate ventilation and weep.

BRIEF DESCRIPTION OF THE DRAWING FIGURES

DESCRIPTION OF THE PREFERRED EMBODIMENTS

As described in the background section, the overhang portion of a tiled roof (eave) is subject to invasion by wind driven rain, birds, small mammals, and insects if left unclosed. It is an object of the present invention to provide an eave closure that keeps the aforementioned elements from entering the eave section of a tiled roof where they may do damage. It is also an object of the present invention to provide an eave closure that is flexible and strong such that it will re-assume it's original form if deformed, and that will be strong enough to resist deformation in the first place. The method and apparatus of the present invention is described in enabling detail in the various embodiments below.

Figure 1:
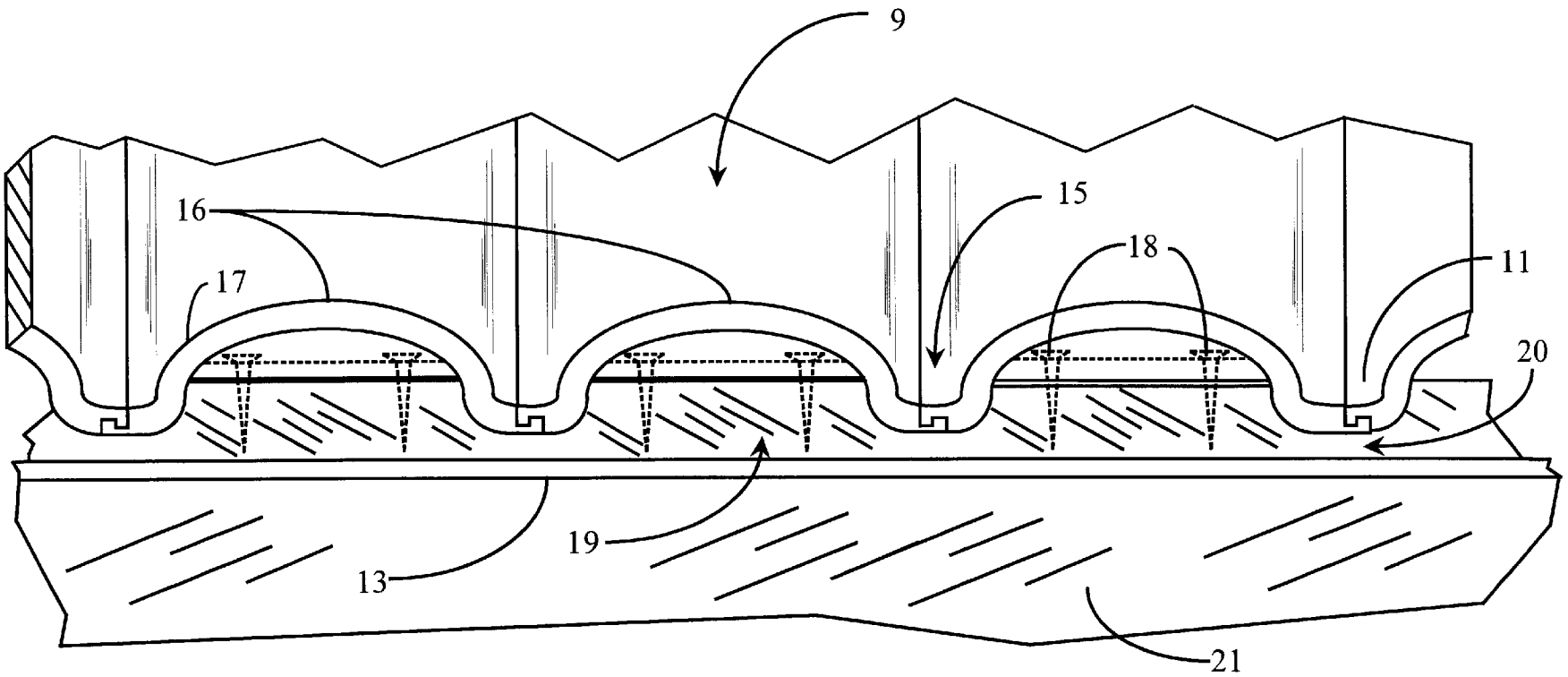
FIG. 1 is a broken elevation-view of an eave roof section with tiles installed as is known in the art.

FIG. 1 is a broken elevation-view of a roof section 9 with edge tiles 17 installed as is known in the art. Roof section 9 is shown without an eave closure in this embodiment in order to better illustrate the elements that would be blocked from view by such a closure.

Roof section 9 comprises an eave board 21, a sheet of plywood underlayment 13, a bat board 11, and tiles 17. Eave board 21 supports the overhang of roof-section 9 including the weight of tiles 17. Some common components to the construction of an eave overhang such as overhang support beams and perhaps a rain gutter are not shown in this embodiment for the purpose of simplifying description, however, they may be assumed to be present.

Plywood 13, usually provided in the form of panels, is laid horizontally in sheets along the general slope of a roof such that it overhangs eave board 21 by a predetermined amount depending on, among other things, the slope of the roof. Plywood 13 is nailed to wooden support beams (not shown) that are joisted together to form the rigid support for accepting a tile roof.

Bats 11 (wooden strips) are strategically located in horizontal rows and nailed to plywood 13. Bats 11 are designed to support a row of tiles 17. In this example, only the end bat (closest to the overhang) is visible. Tiles 17 are illustrated as nailed to bat 11 with roofing nails 18. In this way, tiles 17 are rigidly held in place as is known in the art. Tiles 17, when properly installed, interlock with each other to form a contiguous row of adjacent tiles exhibiting the familiar serpentine profile of arcuate sections bordered by valley sections as illustrated by element numbers 16 (arcuate sections) and element number 15 (valleys).

Tiles 17 are nailed to bat 11 as described above. As a result of this, tiles 17 do not sit flush against plywood 13, rather, there is a void 20 left underneath tiles 17. Void 20 is formed by the gap existing beneath tiles 17 as a result of their nailed positions to bat 11. A part of void 20 illustrated as element number 19 represents the natural hollow formed by the shape of tiles 17. Hollow areas 19 would exist even if the tiles were seated flush against plywood 13. The open area described as void 20 including hollows 19 extends the entire horizontal length of a row of tiles 17 and backward (up the pitch) to the first bat 11. If left uncovered, as in this example, void 20 is certainly large enough for small animals to enter and nest. Insects and other elements such as rain may enter as well.

In typical prior art, the area described by void 20 including hollows 19 is sometimes closed with a sheet-metal eave closure of the form of an elongated L-shaped strip that is designed to cover the minor gap 20 and the larger hollows 19 by virtue of it's cut shape. Such a prior art eave closure is detailed below.

Figure 2:
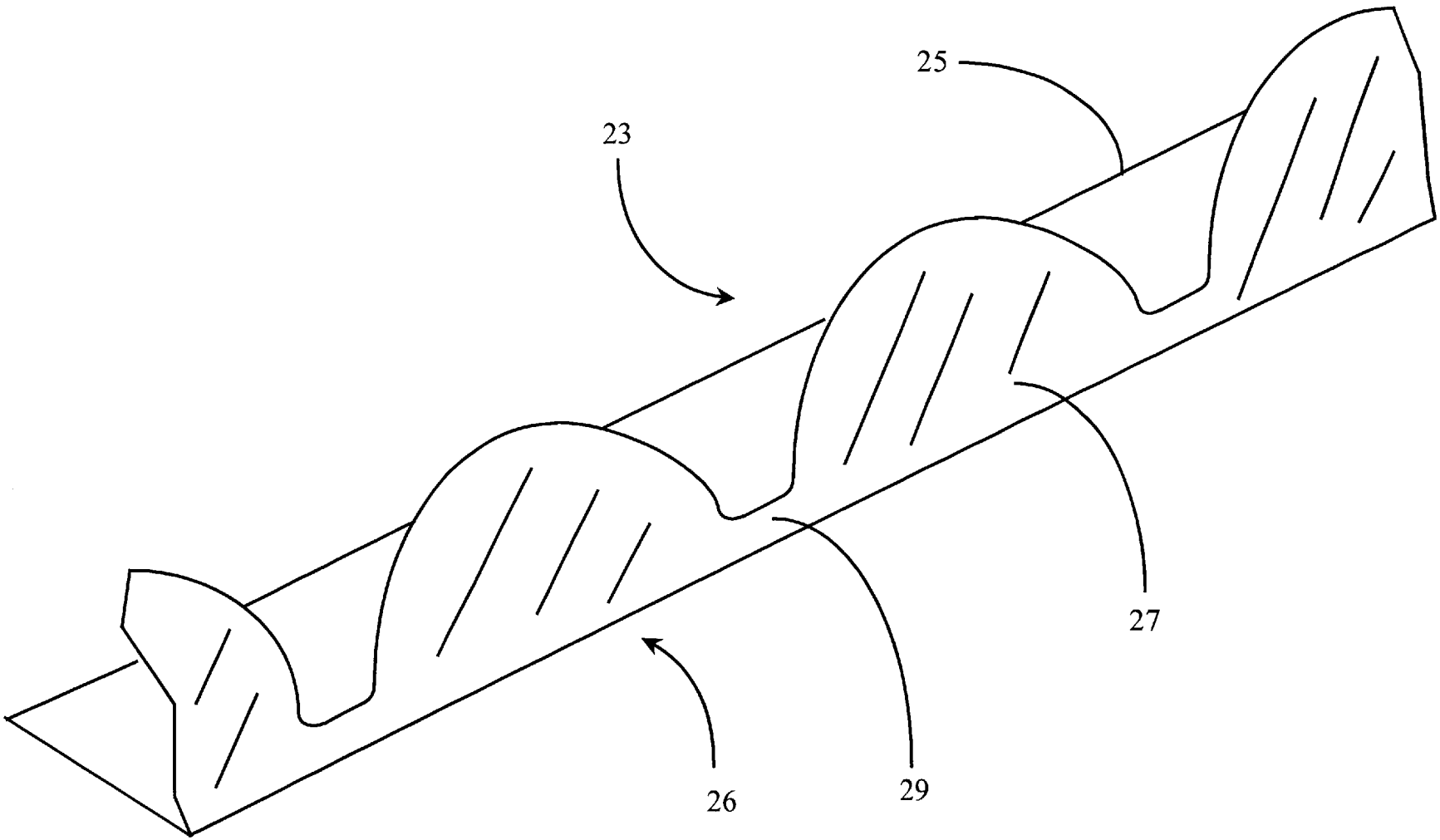
Fig. 2 (Prior Art)
FIG. 2 is a perspective and broken view of a section of a sheet-metal eave closure according to prior art.

FIG. 2 is a perspective and broken view of a section of a sheet-metal eave closure 23 according to prior art. Eave closure 23 is an elongated sheet-metal strip used to fill or cover void areas such as void 20 including hollows 19 of FIG. 1. Eave closure 23 is formed as an L-shaped strip having a riser portion 26 and a nailing flange 25. Riser portion 26 is cut to a shape that conforms to the serpentine profile of a row of installed tiles such as tiles 17 (FIG. 1). For example, riser 26 has arcuate sections 27 separated by valley sections 29. The profile presented by eave closure 23 preferably matches the profile created by a row of installed tiles such as tiles 17.

Eave closure 23 is adapted to be nailed to plywood such as plywood 13 of FIG. 1 by driving the nails through nailing flange 25. When in position, riser 26 fits just underneath tiles 17 blocking void 20 including hollows 19 from foreign invasion from animals and the like.

One problem with eave closure 23 is that it is available from the manufacturer in limited dimensional lengths such as in 10-foot strips. Often tiles will vary somewhat in width depending on the tolerance applied during manufacture. Therefore, when a row of tiles is installed and in-place such as tiles 17 (FIG. 1), the serpentine profile of void 20 will also vary dimensionally, center-to-center, along the entire length of the row. This produces the probability that the profile of riser portion 26 of closure 23 will not exactly match the tile profile in every case. Often the closure strips (23) must be cut and risers 26 must be trimmed to obtain a satisfactory profile match over the length of a roof section such as section 9.

Another problem is that eave closure 23 is made of sheet metal that is malleable and not reinforced. The properties of tin or sheet metal are that once deformed or crumpled, it cannot regain its original shape without substantial manual reshaping. For example, if a force of weight is applied to the surface of a row of tiles, such as by a worker walking on them or the like, then an installed eave closure such as closure 23 will buckle and become deformed under the weight and natural give of the tiles. When the weight is removed, the tiles will spring back into position while the eave closure will not. As a result, the areas deformed by buckling may leave small openings where insects and in some case small animals may again enter the roof. A fact that the larger hollow portion (19) of void 20 may now be partially blocked may be more appealing to nest builders such as small birds, bees, or wasps.

Still another consideration is that an eave closure such as closure 23, undamaged, has no means for allowing the roof area to breath. If a closure such as closure 23 is installed without deforming wherein the area described by void 20 including hollows 19 of FIG. 1 is substantially covered, then moisture may condense on the inside (void area) causing water damage leading to eventual wood rot. This moisture cannot weep.

To solve these problems, the inventor provides a molded eave closure that is resilient and strong such that it will support heavy loads, and, if somewhat deformed, will regain it's shape naturally. Detailed disclosure of such an eave closure is provided below.

Figure 3A:
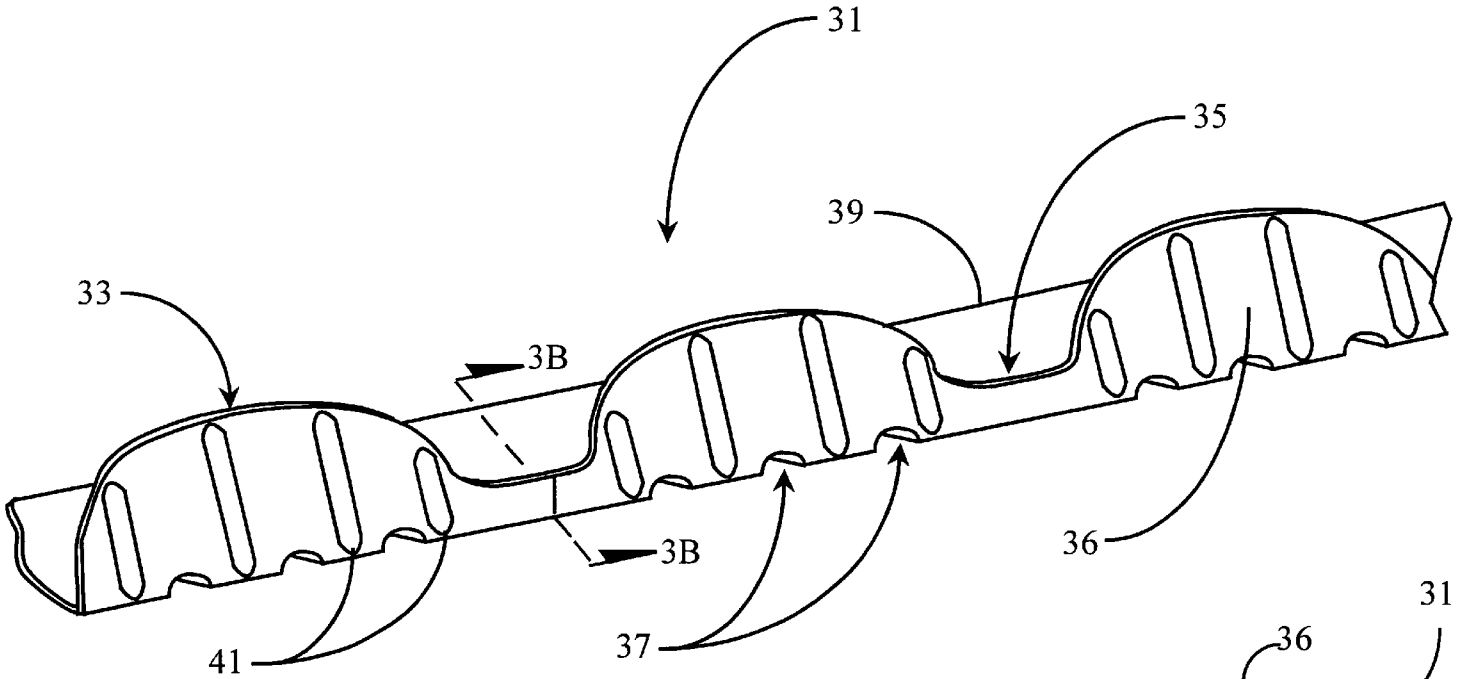
FIG. 3A is a perspective and broken view of a section of molded eave-closure reinforced according to an embodiment of the present invention.

FIG. 3A is a perspective and broken view of a section of molded eave-closure 31 re-enforced according to an embodiment of the present invention. Eave closure 31 is provided as an elongated L-shaped strip adapted to cover or fill the aforementioned void area defined above. Closure 31 is manufactured from a durable, weather-resistant polymer material, such as polypropylene, that has sufficient properties of resilience and strength, and is resistant to heat damage.

Closure 31 has a flange portion 39 adapted as a nailing surface for securing to plywood such as plywood 13 of FIG. 1. Closure 31 also has a riser portion 36 that conforms to the serpentine profile of a row of tiles such as tiles 17 (FIG. 1). For example, arcuate sections 33 are separated on each side by valley sections 35 creating the required profile.

The surface of riser portion 36 of closure 31 is reinforced with a plurality of vertically extending grooves 41 formed therein during molding. Grooves 41 are, in this example, contained within the surface of riser 36, however they may run out to the edges of the surface in other embodiments. Grooves 41 may be located on either side of the surface of riser 36 or they may be located in combination on both sides. In this example, they are formed in the surface of riser 36 that faces away from nailing flange 39. Grooves 41 are not confined to a vertical arrangement. Instead, they may be provided as lateral or angled reinforcement features. There are many possibilities.

The main function of grooves 41 is to reinforce riser 36 such that it resists crumpling or deformation due to added weight from the roof surface. The combination of material type (resilient polymer) and reinforcement grooves 41 provides maximum strength and resiliency to closure 31 allowing it to firstly resist being deformed or crumpled at all. However, if the weight applied to the roof over closure 31 is heavy enough to overcome the reinforcement provided by grooves 41, then the resilient material will cause closure 31 to spring back to it's original position once the weight is removed. Grooves 41 of themselves provide an exponential increase in support strength for tiles 17 (FIG. 1) over prior art closures.

There may be more or fewer grooves 41 provided in riser 36 than are illustrated herein without departing from the spirit and scope of the present invention. The inventor deems that four such grooves for each section 33 are sufficient for explanation of the present invention.

Closure 31 may be provided in a variety of lengths, however, in a preferred embodiment, lengths of approximately four feet are desired. The preferred length of approximately four feet allows profile matching to be achieved more accurately without requiring excessive trimming and the like. A shorter material length then described with respect to prior art also promotes easier material handling.

In addition to grooves 41, the inventor provides a plurality of passages 37 formed on the undersurface of nailing flange 39 and adapted to allow a roof section to breathe. Passages 37 allow any internal moisture caught in a roof section such as section 9 to weep out, and for air to circulate, without providing an invasion passage for wind-driven rain. Passages 37 are not formed in a straight-line direction, but rather in a zigzag direction that is described further below.

Figure 3B:
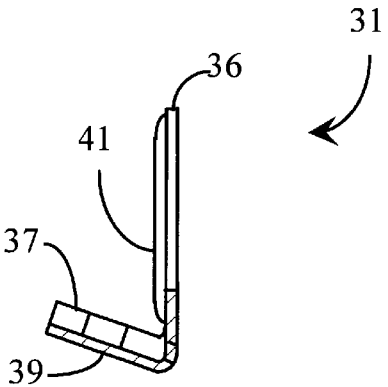
FIG. 3B is a cross section of the closure of FIG. 3A taken along section line 3B—3B of FIG. 3A.

FIG. 3B is a section view of closure 31 taken along section line 3B—3B of FIG. 3A. The element numbers are the same as in FIG. 3A for the various elements. The angle of flange 39 with risers 36 can vary considerably. In some embodiments this angle may be 90 degrees, which provides the best visual effect, and in others the angle may conform to the pitch of the roof line to provide for riser 36 to be vertical in installation, which provides the best support for a person walking on tiles along the eave line. In other embodiments the angle may be a compromise between these angles.

Figure 4:
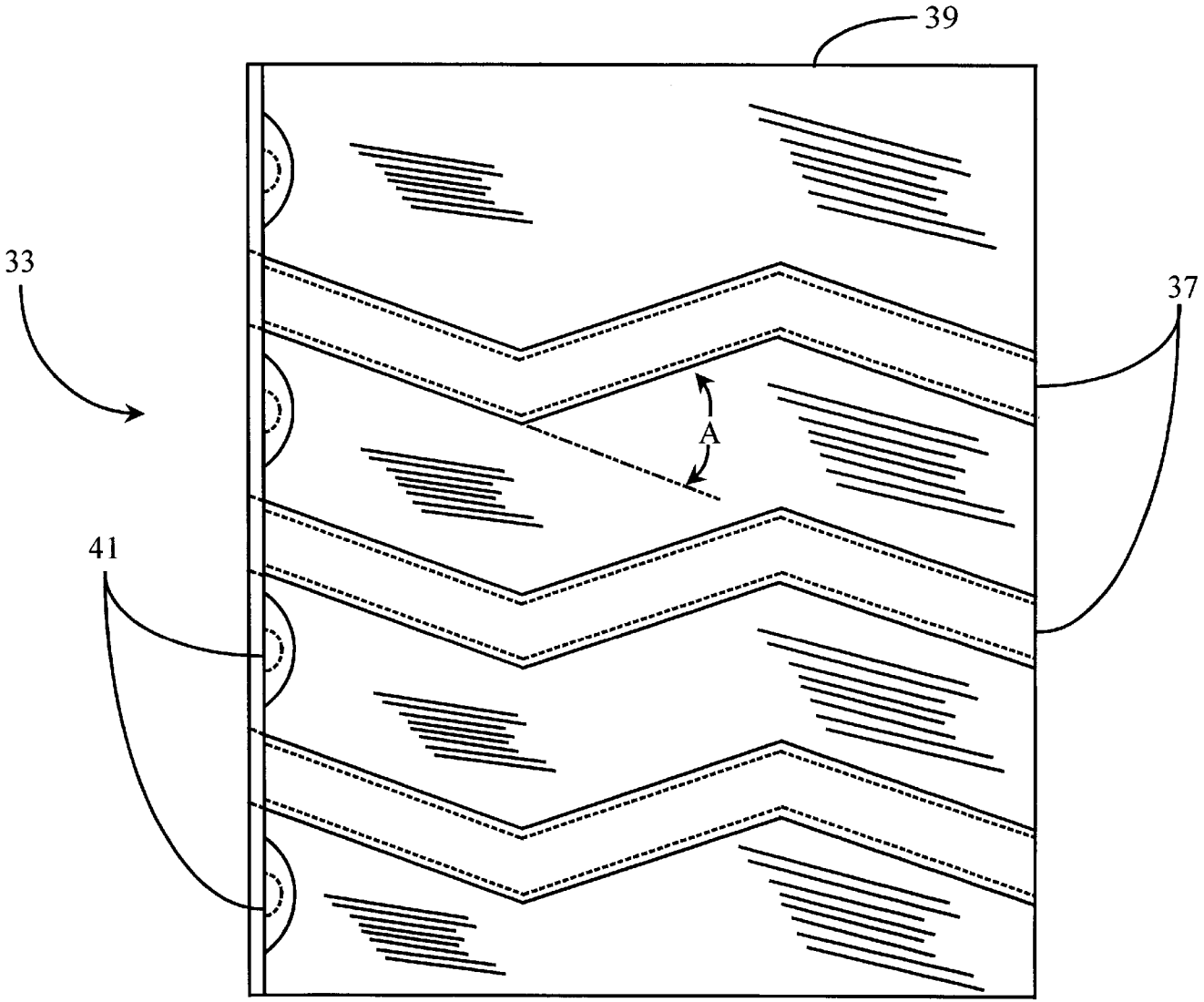
FIG. 4 is an overhead view of one portion of the eave closure of FIG. 3.

FIG. 4 is an overhead view of one arcuate section 33 of eave closure 31 of FIG. 3 according to an embodiment of the present invention. Arcuate section 33 exhibits an L shaped construction comprising nailing flange 39 and riser section 36. Riser section 36 contains reinforcement grooves 41 as previously described. Flange 39 contains passages 37 that were introduced in FIG. 3 above.

Passages 37 are illustrated as being formed in a zigzag fashion across nailing flange 39. The formation of passages 37 in a zigzag fashion achieves two basic purposes. One is that passages 37 allow any condensed moisture to weep out from the eave section while inhibiting wind-driven rain from making any substantial progress into the structure. Another reason is that insects venturing into passages 37 are not likely to continue past the first bend since the second leg of the zigzag pattern is not viewable from the riser portion 36.

Passages 37 are directionally offset at an angle A. Angle A is, in this embodiment, approximately 30 degrees. In other embodiments, a different angle may be preferred. The offset is responsible for inhibiting small insects and wind driven rain from entering past the first bend. Each groove 37 has two directionally alternating bends; however, there may be more or fewer bends without departing from the spirit and scope of the present invention.

Passages 37, like reinforcement grooves 41, help too stabilize and strengthen closure 31 (FIG. 3). Although only one arcuate section of closure 31 is illustrated here, it may be assumed that closure 31 is manufactured in approximated four-foot sections or strips. In other embodiments, longer or shorter strips may be used.

The embodiments of the invention thus far described are sufficient for many applications. There are, however, a few applications wherein an additional feature is needed. The reinforcing grooves molded into a closure cover such as that of FIG. 3 as previously described, or reinforcement elements used in other embodiments of the present invention, may be visible to individuals when viewed from a position facing the edge of a roof where the closure is installed. The visual effect may be undesirable to some individuals.

To solve this problem the inventor provides a molded eave closure cover that, in an it embodiment of the present invention, avoids the visual effect by blocking the view of the grooves or other reinforcement elements used. In a preferred embodiment an eave closure cover is for use in conjunction with eave closure 31. Detailed disclosure of such a closure cover is provided below.

Figure 5:
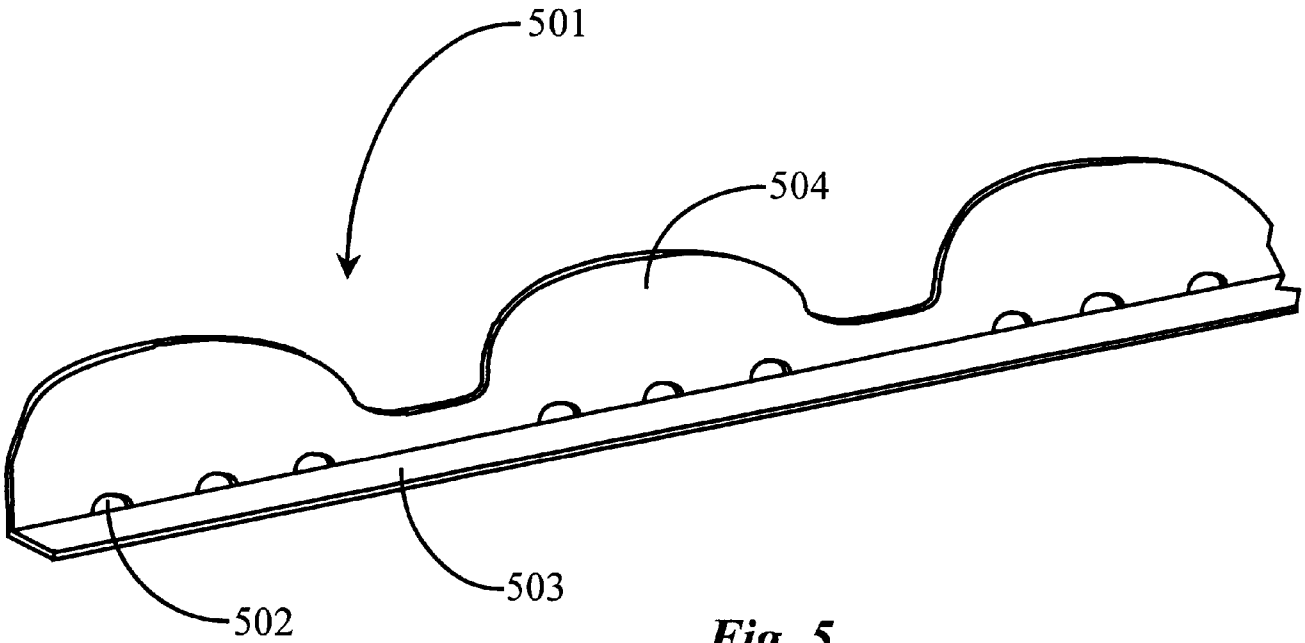
FIG. 5 is a perspective and broken view of a section of a closure cover according to an embodiment of the present invention.

FIG. 5 is a perspective and broken view of a section of a closure cover according to an embodiment of the present invention. Closure cover 501 is provided as an elongated L-shaped strip adapted to provide a means of blocking the visual effect of a reinforced eave closure as previously described in FIG. 3. In a preferred embodiment cover 501 is manufactured from a durable, weather-resistant polymer material, such as polypropylene, similar to that of molded eave closure 31. Cover 501 may be provided in many lengths, however, in a preferred embodiment lengths of approximately four feet are desired, as is true for eave closure 31.

Cover 501 is provided with a flange 503 adapted as a surface for securing to roof underlayment such as plywood 13 of FIG. 1. The method of securing cover 501 to roof underlayment may vary, but in this embodiment the securing is achieved by way of nailing flange 503 to the underlayment surface in a fashion similar to that of closure 31. Cover 501 also has riser portions 504 that, as is true for eave closure 31, conform to the serpentine profile of a row of tiles such as tiles 17 of FIG. 1. In this embodiment cover 501 is installed against the front surface of previously installed eave closure 31. Cover 501 eliminates any undesirable visual effects caused by reinforcement elements due to the conformity of shape and size between cover 501 and eave closure 31.

In the embodiment of FIG. 5 an opening 502 is provided in riser portion 504 to coincide with each passage 37 of the closure 31, allowing for unrestricted air circulation between inside and outside an installed closure 31 through passages 37 as described above.

Figure 6:
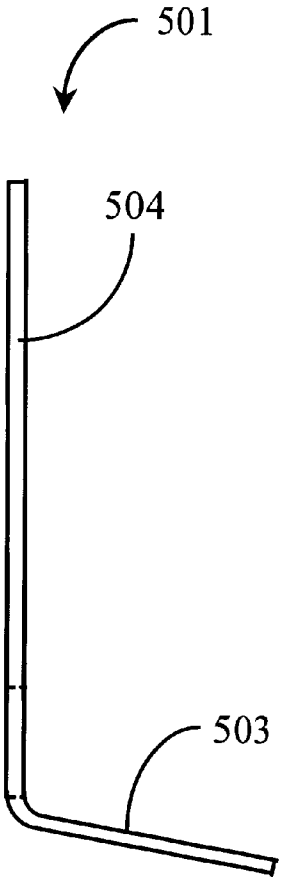
FIG. 6 is an enlarged side view of the closure cover of FIG. 5

FIG. 6 is a side view of closure cover 501 of FIG. 5. As is true for closure 31, the thickness of material and length of cover 501 may vary. In a preferred embodiment the thickness will be sufficient to withstand excessive elements of wind, rain, erosion and wind-driven materials and the like. The angle of flange 503 with risers 504 may vary from embodiment to embodiment as described above for closure 31.

In some embodiments the closures 31 and 501 may be molded together of a single piece of material, such that the two closures are joined, such as by a strip at the top of each riser. In other embodiments the molding may be done so one closure is produced as a clamshell design, wherein the two shapes 31 and 501 are joined all along the upper edge of the risers. In yet another embodiment the closures are molded separately and then joined by heat joining or by any of several other means of joining two polymer pieces, including joining by adhesives and separate joining clips and the like.

Figure 7:
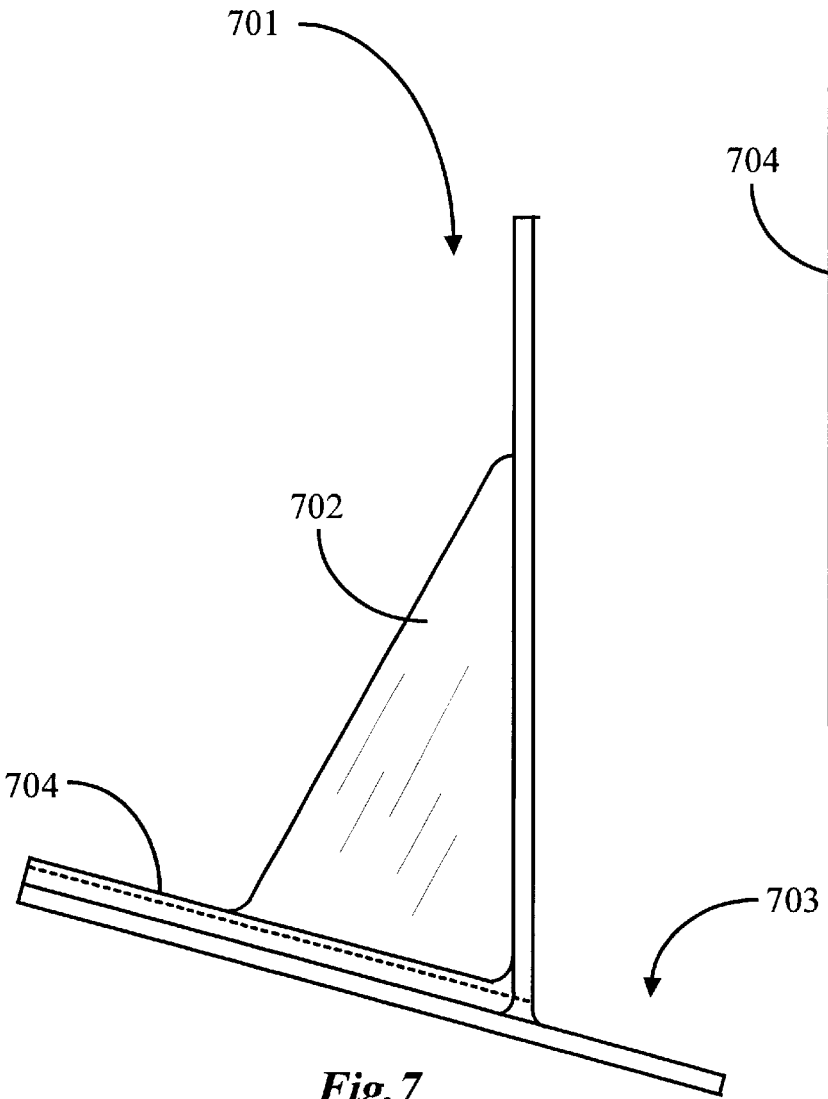
FIG. 7 is a side view of an eave closure reinforced according to another embodiment of the present invention.

FIG. 7 is a side view of an eave closure 701 in yet another embodiment of the present invention. Closure 701 provides an angled brace 702 providing added rigidity to the overall structure. The rear-facing position of brace 702 enables the ability to withstand added weight as is described above for reinforced closure 31, but eliminates the need for also installing a cover such as cover 501 to hide any undesirable visual effect of reinforcement elements. The embodiment of FIG. 7 is not amenable to molding from a single sheet of material, as is typically done for other embodiments, but can be, for example, injection molded.

Another undesirable visual effect common in roof tile installations of the type described, is a portion of underlayment materials that protrudes from the bottom edge of the roof once the tiles are in place an fastened to the roof, and closures 31 are in place. Flange 503 of closure 501 and flange 703 of closure 701 solves this problem, providing added protection for that small protrusion of underlayment material that might not otherwise be covered.

Figure 8:
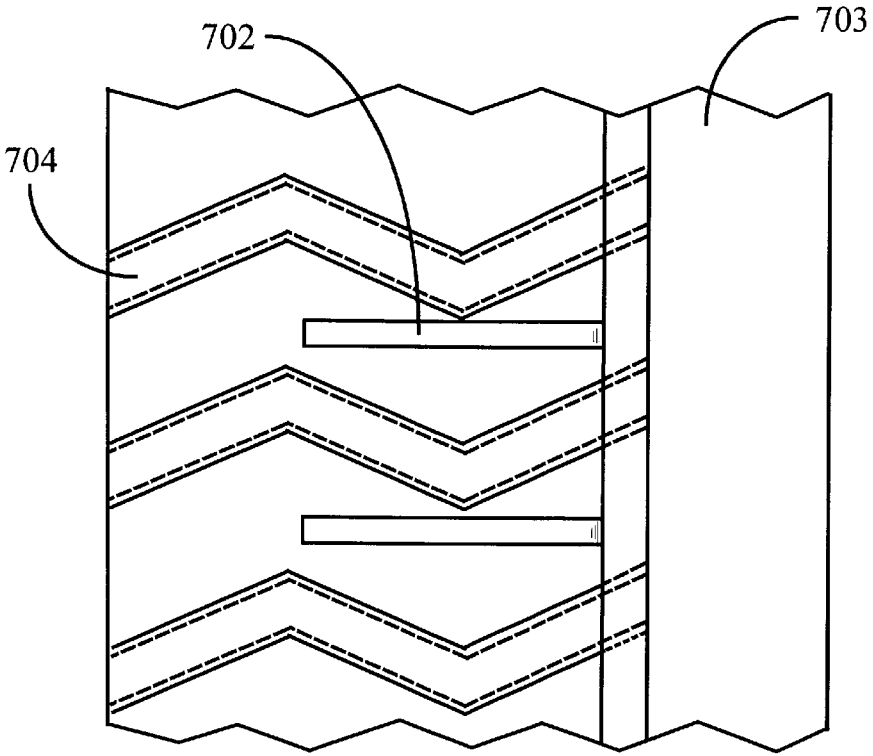
FIG. 8 is a broken overhead view of one portion of the eave closure of FIG. 7.

FIG. 8 is an overhead view of closure 701 of FIG. 7, showing views of passages 704 and placement of braces 702. The quantity, shape and placement of braces will vary in different embodiments, as will the height, length and thickness of material. The inside and outside dimensions as well as angle of the passages will also vary in various embodiments.

Figure 9:
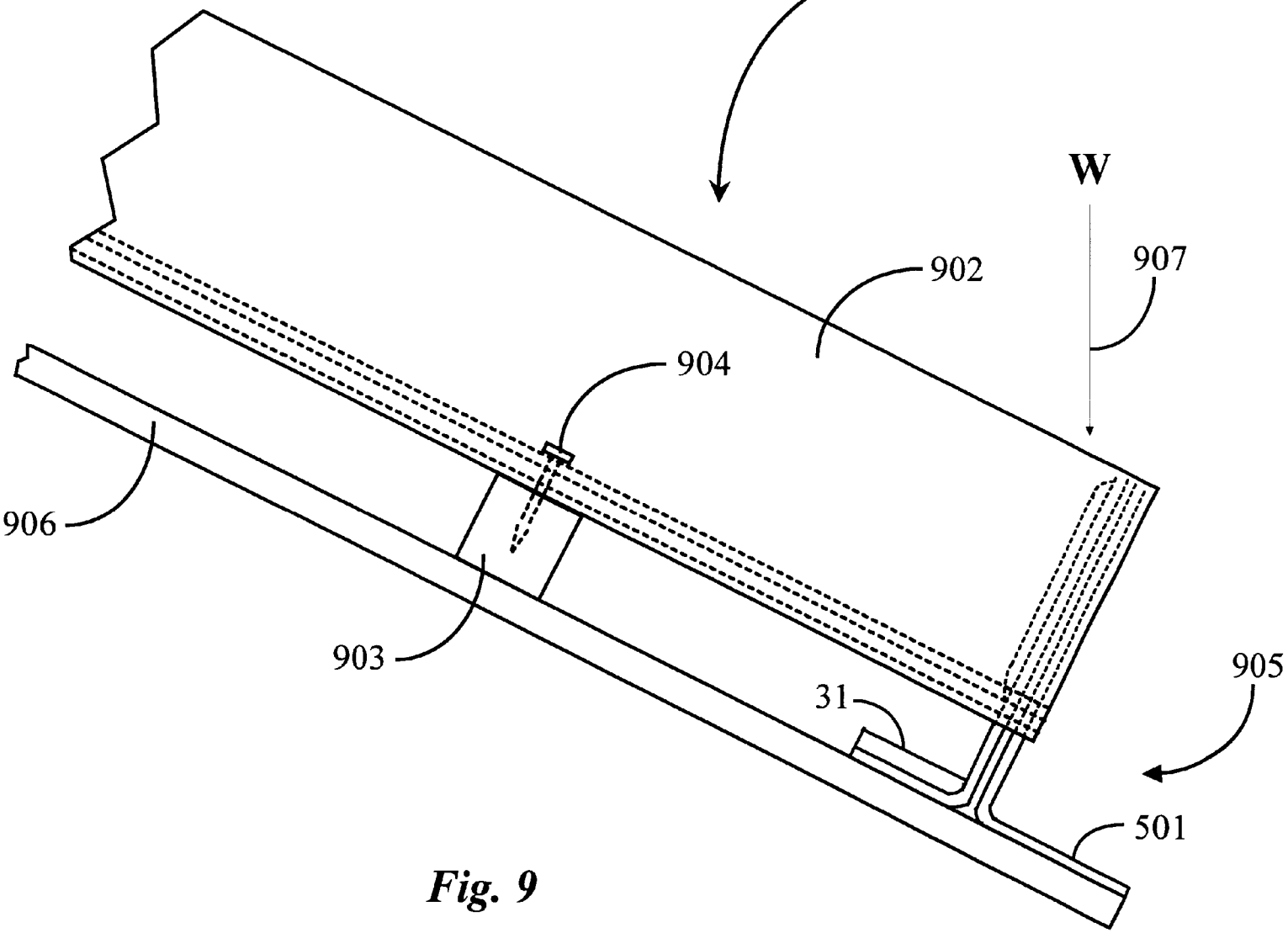
FIG. 9 is a broken side view of a section of roof edge.

FIG. 9 is a broken side view of a roof section 901 depicting end-row tiles 902 installed along the eaves at the edge of a roof. As explained earlier, this is the area on a roof where a first row of tiles is installed. As shown in FIG. 9, edge tiles 902 are nailed to a bat 903. As previously described this well-known manner of attachment results in a void area 905 between the suspended tile and the underlayment depicted by a plywood underlayment 906.

The purpose of depicting the attachment method of FIG. 9 is to illustrate the possible effect of applying a heavy weight, which could be a worker walking along the edge of a roof while performing repairs. When such a weight is applied to the edge of a tile in a downward direction such as a weight 907 shown, breaking or cracking of the tile may result, in addition to other adverse effects previously described. Embodiments previously disclosed having attributes of reinforcement such as closure 31 of FIG. 3 and closure 501 of FIG. 5 provide a solution to the problem by having greater rigidity and resistance to warping. Simplified representations of closures 501 and 31 are shown in FIG. 9 as they might be installed. It will be apparent to the skilled artisan, given the disclosure herein, how closures 31 and 501 would appear if the angles of the risers and flanges were different, and how closure 701 would appear in FIG. 9.

It will be apparent to one with skill in the art that the method and apparatus of the present invention may be practiced on any standard tile roof without departing from the spirit and scope of the present invention. It will also be apparent to one with skill in the art that the eave closure and cover of the present invention may be modified in dimensional size and profile shape to fit any type of tile profile. It should further be apparent to one with skill in the art that grooves 41 and braces 702 may be provided in differing numbers, dimensional sizes, and so on. This is also true for passages 37 and 704.

For these reasons the method and apparatus of the present invention should be afforded the broadest possible scope. The spirit and scope of the present invention should be limited only by the claims that follow.

What is claimed is:

1. An eave closure for tile roofing, comprising:

a nailing flange having a surface extending along a length of the closure;

weep passages provided as grooves formed in an underside of the entire surface of the nailing flange such that air may circulate between inside and outside an installed closure; and a riser portion contiguous with the nailing flange at an angle to the surface of the nailing flange, the riser portion shaped on an upper edge to conform to the shape of the underside of adjacent installed tiles;

characterized in that the riser portion has molded reinforcing grooves adding vertical strength to the eave closure.

2. The eave closure of claim 1 wherein the weep passages follow a center line, with at least one change in direction across the width of the nailing flange.

3. The eave closure of claim 1 further characterized in that the material for molding is a weather-resistance polymer material.

4. The eave closure of claim 1 further characterized in that the length of one closure is equal or less than four feet.

5. A method for closing openings between a line of tiles at an eave edge and an underlayment, comprising the steps of:

(a) molding an eave closure with a nailing flange having a surface extending along a full length of the closure, and a riser portion contiguous with the nailing flange at substantially a right angle to the surface of the nailing flange, the riser portion shaped on an upper edge to conform to the shape of the underside of adjacent installed tiles, characterized in that the riser portion has molded reinforcing grooves adding vertical strength to the eave closure;

(b) forming weep passages provided as grooves formed in an underside of the entire surface of the nailing flange such that air may circulate between inside and outside an installed closure;

(c) nailing the eave closure adjacent to and parallel the eave edge of a roof; and (d) installing tiles side-by-side over the eave closure.

6. The method of claim 5 wherein the weep passages follow a center line, with at least one change in direction across the width of the nailing flange.

7. The method of claim 5 further characterized in that the material for molding is a weather-resistance polymer material.

8. The method of claim 5 wherein the eave closure is further characterized in that the length of one closure is equal or less than four feet, and successive closures are adjusted to compensate for dimensional errors and tolerances as tiles are laid.

9. An eave closure for tile roofing, comprising:

a first flange having a surface extending along a length of the closure, including weep passages provided as grooves formed in an underside of the entire surface of the flange such that air may circulate between inside and outside the closure;

a first riser portion contiguous with the nailing flange at an angle to the surface of the nailing flange, the riser portion shaped on an upper edge to conform to the shape of the underside of adjacent installed tiles, the first riser portion having molded reinforcing grooves adding vertical strength to the eave closure;

a second riser portion congruent with and adjacent to the first riser portion, the second riser portion having a smooth surface devoid of reinforcing grooves; and a second flange extending from the second riser portion in a direction opposite the direction of the first flange.

10. An eave closure for tile roofing, comprising:

a flange having a surface extending along a length of the closure including weep passages provided as grooves formed in an underside of the entire surface of the flange such that air may circulate between inside and outside the closure;

a riser portion contiguous with the nailing flange at an angle to the surface of the nailing flange, the riser portion shaped on an upper edge to conform to the shape of the underside of adjacent installed tiles; and angled reinforcements joining the flange and riser portions.

* * * * *